US007174992B2

(12) United States Patent
Kicinski

(10) Patent No.: US 7,174,992 B2
(45) Date of Patent: Feb. 13, 2007

(54) MUFFLER WITH SECONDARY FLOW PATH

(75) Inventor: Kenneth J. Kicinski, Sun Prairie, WI (US)

(73) Assignee: Fleetguard, Inc., Nashville, TN (US)

( * ) Notice: Subject to any disclaimer, the term of this patent is extended or adjusted under 35 U.S.C. 154(b) by 397 days.

(21) Appl. No.: 10/818,392

(22) Filed: Apr. 5, 2004

(65) Prior Publication Data

US 2005/0217929 A1 Oct. 6, 2005

(51) Int. Cl.
*F01N 1/04* (2006.01)
*F01N 1/24* (2006.01)
*F01N 1/02* (2006.01)

(52) U.S. Cl. ..... 181/255; 181/249; 181/251; 181/253; 181/257; 181/268; 181/269; 181/275

(58) Field of Classification Search ..... 181/255, 181/249, 251, 252, 253, 256, 257, 268, 269, 181/272, 275, 227, 228
See application file for complete search history.

(56) References Cited

U.S. PATENT DOCUMENTS

| | | | | | |
|---|---|---|---|---|---|
| 1,076,494 | A | * | 10/1913 | Galaine | 181/253 |
| 1,338,520 | A | * | 4/1920 | Moores | 181/253 |
| 1,387,614 | A | * | 8/1921 | Reid | 181/253 |
| 1,938,973 | A | * | 12/1933 | Oldberg | 181/250 |
| 2,034,186 | A | * | 3/1936 | Heath | 181/253 |
| 2,036,138 | A | * | 3/1936 | Haas | 181/253 |
| 2,059,487 | A | * | 11/1936 | Peik | 181/252 |
| 2,065,343 | A | * | 12/1936 | Mitchell et al. | 181/256 |
| 2,353,914 | A | * | 7/1944 | McLeod | 181/257 |
| 2,514,520 | A | * | 7/1950 | Sauer | 181/253 |
| 2,834,425 | A | * | 5/1958 | Rawson | 181/252 |
| 2,937,707 | A | * | 5/1960 | Ernst | 181/252 |
| 3,480,105 | A | * | 11/1969 | Burris | 181/255 |
| 3,515,242 | A | * | 6/1970 | Lyttle | 181/268 |
| 3,672,464 | A | * | 6/1972 | Rowley et al. | 181/253 |
| 4,055,231 | A | * | 10/1977 | Martinez | 181/241 |
| 4,108,275 | A | * | 8/1978 | Black et al. | 181/252 |
| 4,487,289 | A | * | 12/1984 | Kicinski et al. | 181/252 |
| 4,969,537 | A | * | 11/1990 | Wagner et al. | 181/255 |
| 5,426,269 | A | * | 6/1995 | Wagner et al. | 181/232 |
| 5,661,272 | A | * | 8/1997 | Iannetti | 181/256 |
| 5,892,186 | A | * | 4/1999 | Flugger | 181/252 |
| 6,082,487 | A | | 7/2000 | Angelo et al. | |
| 6,334,506 | B1 | * | 1/2002 | Hamrin et al. | 181/249 |
| 6,354,398 | B1 | | 3/2002 | Angelo et al. | |
| 6,520,286 | B1 | * | 2/2003 | Frederiksen et al. | 181/256 |

FOREIGN PATENT DOCUMENTS

| | | | |
|---|---|---|---|
| JP | 61207813 | A * | 9/1986 |
| JP | 02112608 | A * | 4/1990 |
| JP | 02169812 | A * | 6/1990 |

* cited by examiner

*Primary Examiner*—Edgardo San Martin
(74) *Attorney, Agent, or Firm*—Andrus, Sceales, Starke & Sawall, LLP; J. Bruce Schelkopf

(57) ABSTRACT

A muffler has a main body, and an inner shell spaced radially inwardly of the main body by an annular volume therebetween. The inner shell has an internal volume radially inward of the annular volume. The muffler has primary and secondary parallel paths therethrough, with the primary path extending through the internal volume, and the secondary path extending through the annular volume.

16 Claims, 1 Drawing Sheet

MUFFLER WITH SECONDARY FLOW PATH

BACKGROUND AND SUMMARY

The invention relates to mufflers, including for trucks having engine retarders including engine compression brake-type systems.

Mufflers are known for trucks having diesel engine retarders, sometimes called engine compression brakes, including those available under the trademark "Jake Brake". The present invention arose during continuing development efforts directed to mufflers, including mufflers for diesel engine retarders. The present invention provides an alternate or secondary path providing additional attenuation of noise, and lowering back pressure.

BRIEF DESCRIPTION OF THE DRAWING

Sole

DETAILED DESCRIPTION

Figure 1:
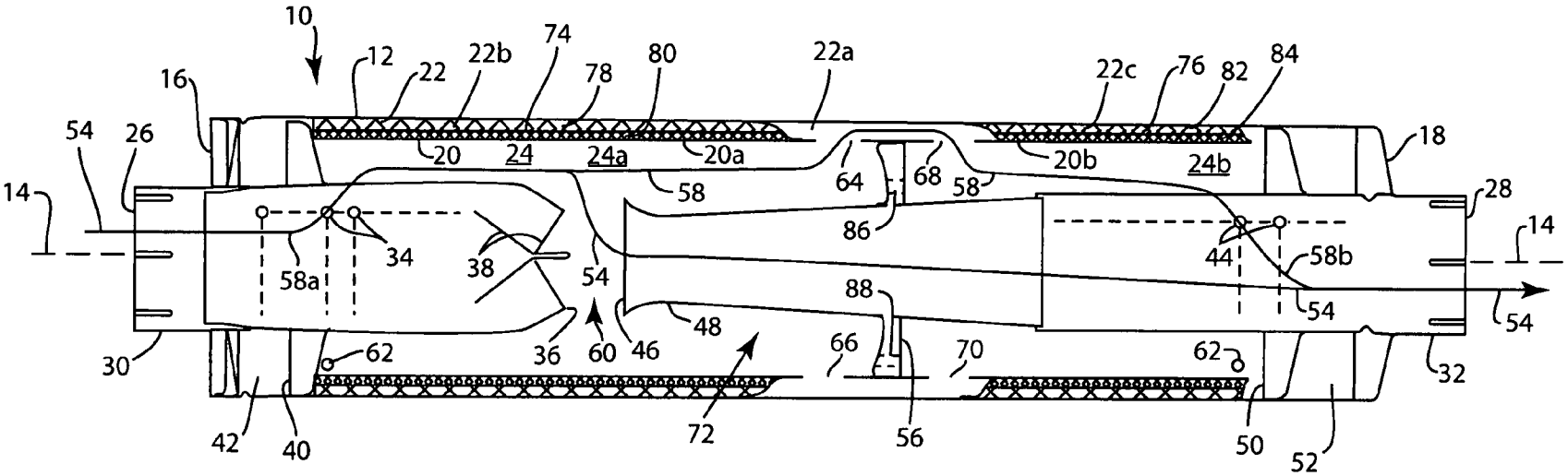
FIG. 1 is a sectional view of a muffler constructed in accordance with the invention.

FIG. 1 shows a muffler 10 having a main body 12 extending axially along an axis 14 between distally spaced first and second axial ends 16 and 18. An inner perforated shell 20 is spaced radially inwardly of main body 12 by an annular volume 22 therebetween. The term annular includes various closed-loop shapes such as cylindrical, oval, race-track-shaped, etc., taken transversely to axis 14. Inner shell 20 has an internal volume 24 radially inward of annular volume 22. The muffler has an inlet 26 receiving exhaust into internal volume 24, and has an outlet 28 discharging exhaust from internal volume 24. The inlet is provided by an inlet tube 30 extending axially into internal volume 24. The outlet is provided by an outlet tube 32 extending axially into internal volume 24. Inlet tube 30 is perforated as shown at perforations 34. The downstream inner end 36 of the inlet tube may be closed, for example by star-crimping as shown at star-crimps 38 as known, such that exhaust entering inlet tube 30 at inlet 26 must pass through perforations 34 into internal volume 24. A flange 40 may be provided and extends radially between inlet tube 30 and body 12 and/or inner shell 20 to provide an inlet resonant chamber 42, as is known. Outlet tube 32 is perforated as shown at perforations 44. The upstream inner end 46 of the outlet tube may have a venturi throat section 48 as is known for receiving exhaust from internal volume 24. A flange 50 may extend radially between outlet tube 32 and main body 12 to define an outlet resonant chamber 52 as is known.

The muffler has a primary flow path 54 therethrough passing through inlet tube 30 then through perforations 34 then into internal volume 24 then to inner end 46 of outlet tube 32 then through outlet tube 32 to exit as shown at right hand arrow 54. A flange 56 extends radially between inner shell 20 and one of the inlet and outlet tubes, preferably outlet tube 32, and provides a secondary flow path 58 through the muffler. Secondary flow path 58 has a first portion 58*a* passing through inlet tube 30 coincident with primary flow path 54 then through perforations 34 then into internal volume 24 at upstream section 24*a* thereof then into a flow section 22*a* of annular volume 22. Secondary flow path 58 continues to a second portion 58*b* passing from flow section 22*a* of annular volume 22 then into downstream section 24*b* of internal volume 24 then through perforations 44 to rejoin primary flow path 54 and pass through outlet tube 32 to exit at outlet 28. Downstream end 36 of inlet tube 30 and upstream end 46 of outlet tube 32 are axially spaced by an axial gap 60 therebetween along primary path 54. Section 24*b* of internal volume 24 is preferably downstream of axial gap 60. Flow section 22*a* of annular volume 22 is preferably downstream of axial gap 60 and circumscribes outlet tube 32.

Muffler 10 passes exhaust from upstream to downstream from inlet 26 to outlet 28. Downstream portion 58*b* of secondary flow path 58 is downstream of and in series with upstream portion 58*a* of secondary flow path 58. Secondary flow path 58 is in parallel with primary flow path 54 in internal volume 24. Inner shell 20 is perforated as shown at perforations 62. Inner shell 20 also has a plurality of circumferentially spaced openings 64, 66, etc., upstream of flange 56. Inner shell 20 has another set of a plurality of circumferentially spaced openings 68, 70, etc., downstream of flange 56. Secondary flow path 58 passes around flange 56, namely passing from upstream section 24*a* of internal volume 24 through the first set of openings 64, 66 into flow section 22*a* of annular volume 22 on the upstream side of flange 56, and then passing from flow section 22*a* of annular volume 22 through the second set of openings 66, 70 into downstream section 24*b* of internal volume 24 on the downstream side of flange 56. Flange 56 blocks flow axially therepast, but permits flow therearound through flow section 22*a* of annular volume 22.

Inlet tube 30 has the noted inner end 36 in internal volume 24. Outlet tube 32 has the noted inner end 46 in internal volume 24 axially spaced downstream from inner end 36 of inlet tube 30 by axial gap 60 therebetween. The first set of openings 64, 66 in inner shell 20, the flange 56, and the second set of openings 68, 70 in inner shell 20 are each axially downstream of inner end 46 of outlet tube 32. Flange 56 is spaced axially downstream from inner end 46 of outlet tube 32 by a second axial gap 72 having a greater axial length than first axial gap 60. Inner shell 20 has a first section 20*a* upstream of the first set of openings 64, 66 in the inner shell. Inner shell 20 has a second section 20*b* downstream of the second set of openings 68, 70 in the inner shell. Each of the first and second sections 20*a* and 20*b* of inner shell 20 is perforated, as shown at perforations 62. First and second sections 20*a* and 20*b* of inner shell 20 are axially spaced by the noted first and second sets of openings 64, 66 and 68, 70 therebetween. First and second regions of sound adsorption material 74 and 76 may be provided in first and second sections 22*b* and 22*c*, respectively, of annular volume 22 at the first and second sections 20*a* and 20*b*, respectively, of inner perforated shell 20. The first and second regions of sound adsorption material 74 and 76 are axially spaced by a void section 22*a* of annular volume 22 therebetween, which void section provides the noted flow section of annular volume 22. Secondary flow path 58 passes through the first set of openings 64, 66 in inner shell 20 then through void section 22*a* of annular volume 22 then through the second set of openings 68, 70 in inner shell 20. First region 74 of sound adsorption material may include multiple layers such as 78, 80 of sound adsorption material. Second region 76 of sound adsorption material may include multiple layers such as 82, 84 of sound adsorption material.

In a further embodiment, flange 56 may have openings therethrough, as shown in dashed line at 86, 88, providing a third flow path through the flange in parallel with flow section 22*a* through annular volume 22. The third flow path extends from the noted first portion of the secondary flow path 58 then through openings 86, 88 in flange 56 then to the noted second portion of the secondary flow path 58.

It is recognized that various equivalents, alternatives and modifications are possible within the scope of the appended claims.

What is claimed is:

1. A muffler comprising a main body extending axially along an axis between distally spaced first and second axial ends, wherein said second axial end is axially spaced downstream from said first axial end along a first axial direction, and said first axial end is axially spaced upstream from said second axial end along a second axial direction, said second axial direction being opposite to said first axial direction, an inner shell spaced radially inwardly of said main body by an annular volume therebetween, said inner shell having an internal volume radially inward of said annular volume, said muffler having an inlet receiving exhaust into said internal volume, said muffler having an outlet discharging exhaust from said internal volume, said muffler having primary and secondary parallel paths therethrough, said primary path extending through said internal volume, said secondary path extending through said annular volume along said first axial direction.

2. The muffler according to claim 1 wherein:

said primary path extends from said inlet then through said internal volume then to said outlet;

said secondary path extends from said inlet then through a first section of said internal volume then through said annular volume along said first axial direction then through a second section of said internal volume then to said outlet;

said second section of said internal volume is axially downstream of said first section of said internal volume along said first axial direction.

3. The muffler according to claim 2 wherein:

said muffler passes exhaust therethrough from upstream to downstream from said inlet to said outlet;

said inlet comprises an inlet tube extending axially into said internal volume to a downstream end;

said outlet comprises an outlet tube extending axially into said internal volume to an upstream end;

said downstream end of said inlet tube and said upstream end of said outlet tube are axially spaced by an axial gap along said primary path, said upstream end of said outlet tube being axially spaced downstream of said downstream end of said inlet tube along said first axial direction;

said second section of said internal volume is downstream along said first axial direction from said axial gap.

4. The muffler according to claim 3 wherein said annular volume is downstream along said first axial direction from said axial gap.

5. The muffler according to claim 1 wherein exhaust flow along each of said primary and secondary paths is along said first axial direction without flow reversal to said second axial direction.

6. A muffler comprising a main body extending axially along an axis between distally spaced first and second axial ends, wherein said second axial end is axially spaced downstream from said first axial end along a first axial direction, and said first axial end is axially spaced upstream from said second axial end along a second axial direction, said second axial direction being opposite to said first axial direction, an inner shell spaced radially inwardly of said main body by an annular volume therebetween, said inner shell having an internal volume radially inward of said annular volume, said muffler having an inlet receiving exhaust into said internal volume, said muffler having an outlet discharging exhaust from said internal volume, said inlet comprising an inlet tube extending axially into said internal volume, said outlet comprising an outlet tube extending axially into said internal volume, said muffler having a primary flow path therethrough passing through said inlet tube then into said internal volume then through said internal volume along said first axial direction through said outlet tube, a flange extending between said inner shell and one of said inlet and outlet tubes and providing a secondary flow path through said muffler, said secondary flow path having a first portion passing through said inlet tube then into said internal volume then along said first axial direction into a flow section of said annular volume then through said flow section of said annular volume along said first axial direction, said secondary flow path having a second portion passing from said flow section of said annular volume then into said internal volume along said first axial direction then through said outlet tube.

7. The muffler according to claim 6 wherein:

said muffler passes exhaust therethrough from upstream to downstream from said inlet to said outlet;

said second portion of said secondary flow path is downstream along said first axial direction from and in series with said first portion of said secondary flow path; and said secondary flow path is in parallel with said primary flow path in said internal volume, said parallel primary and secondary flow paths each being in said first axial direction.

8. The muffler according to claim 7 wherein said inner shell has a first opening upstream of said flange along said second axial direction, and a second opening downstream of said flange along said first axial direction, such that said secondary flow path passes around said flange along said first axial direction, namely passing from said internal volume through said first opening into said flow section of said annular volume on an upstream side of said flange, and then Passing from said flow section of said annular volume through said second opening into said internal volume on a downstream side of said flange, said second opening in said inner shell being downstream along said first axial direction from said first opening in said inner shell.

9. The muffler according to claim 8 wherein said flange extends between said inner shell and said outlet tube.

10. The muffler according to claim 9 wherein said inlet tube has an inner end in said internal volume, said outlet tube has an inner end in said internal volume axially spaced downstream along said first axial direction from said inner end of said inlet tube by an axial gap therebetween.

11. The muffler according to claim 10 wherein said first opening in said inner shell, said flange, and said second opening in said inner shell are each axially downstream along said first axial direction from said inner end of said outlet tube.

12. The muffler according to claim 10 wherein said flange is spaced axially downstream along said first axial direction from said inner end of said outlet tube by a second axial gap having a greater axial length than said first mentioned axial gap.

13. The muffler according to claim 8 wherein:

said inner shell has a first section upstream along said second axial direction from said first opening in said inner shell, and a second section downstream along said first axial direction from said second opening in said inner shell;

each of said first and second sections of said inner shell is perforated; and said first and second sections of said inner shell are axially spaced by said first and second openings therebetween.

14. The muffler according to claim 13 comprising first and second regions of sound adsorption material in first and second sections of said annular volume at said first and second sections of said inner shell, respectively, said first and second regions of sound adsorption material being axially spaced by a void section of said annular volume therebetween, said secondary flow path passing through said first opening in said inner shell then along said first axial direction through said void section of said annular volume then through said second opening in said inner shell, said void section providing said flow section of said annular volume.

15. The muffler according to claim 6 wherein said flange has one or more openings therethrough providing a third flow path through said flange in said first axial direction and in parallel with said flow section through said annular volume, said third flow path extending from said first portion of said secondary flow path then along said first axial direction through said one or more openings in said flange then to said second portion of said secondary flow path.

16. The muffler according to claim 6 wherein exhaust flow along each of said primary and secondary paths is along said first axial direction without flow reversal to said second axial direction.

* * * * *